United States Patent [19]

Kubelka et al.

[11] 4,050,716

[45] Sept. 27, 1977

[54] SKI BINDING

[75] Inventors: Axel Kubelka; Gottfried Schweizer, both of Vienna, Austria

[73] Assignee: TMC Corporation, Baar, Switzerland

[21] Appl. No.: 668,572

[22] Filed: Mar. 19, 1976

[30] Foreign Application Priority Data

Apr. 2, 1975 Austria ..... 2499/75

[51] Int. Cl.[2] ..... A63C 9/086

[52] U.S. Cl. ..... 280/614; 280/618; 280/620

[58] Field of Search ..... 280/614, 615, 611, 11.36, 280/618, 620; 36/120, 121

[56] References Cited

U.S. PATENT DOCUMENTS

| | | | |
|---|---|---|---|
| 1,868,386 | 7/1932 | Gresvig | 280/615 |
| 3,543,421 | 12/1970 | Ader | 36/121 |
| 3,775,871 | 12/1973 | Serko | 36/121 |
| 3,870,325 | 3/1975 | Davis | 280/611 |
| 3,893,683 | 7/1975 | Gertsch et al. | 280/611 |

FOREIGN PATENT DOCUMENTS

| | | | |
|---|---|---|---|
| 2,209,621 | 9/1973 | Germany | 280/614 |

*Primary Examiner*—Robert R. Song
*Assistant Examiner*—David M. Mitchell
*Attorney, Agent, or Firm*—Blanchard, Flynn, Thiel, Boutell & Tanis

[57] ABSTRACT

An improvement in a ski binding arrangement wherein a ski boot is secured to a sole plate which in turn is releasably secured to a ski. The ski boot is pivotally secured by a front support to the sole plate and the heel of the ski boot is releasably secured to the sole plate. The ski boot is comprised of two parts, an upper leg part which is pivotally secured about a horizontal axis relative to the lower boot part. The heel holding assembly serves to lock the upper part of the ski boot to the lower part of the ski boot when the skier is using the ski boot in a downhill skiing environment. A movement of the heel holding assembly to a non-use or cross-country skiing position will facilitate a relative movement between the upper leg portion of the ski boot and the lower boot part.

13 Claims, 3 Drawing Figures

SKI BINDING

FIELD OF THE INVENTION

The invention relates to a ski binding having a sole plate releasably secured against a spring force on a ski which has a ski boot mounted thereon by a front support and a heel holding assembly, wherein a two-part ski boot is used, the upper leg portion of which is supported pivotally about an axis relative to the lower boot part.

BACKGROUND OF THE INVENTION

Devices are known which hold a ski boot, having, for example, a jointed leg portion, on a sole plate. The pivotal arrangement of the leg portion is advantageous during normal walking and also during cross-country skiing. However, during downhill skiing, the pivotability of the leg portion is to be limited against rearward movement to assure a proper guidance of the ski. For this purpose, devices have already been suggested which fix the two ski boot parts to one another. These devices are not only complicated in handling and also expensive to manufacture, but also parts result which project from the ski boot and which can be damaged and simultaneously increase the danger of injury. Furthermore, the ski boot becomes heavier, so that the user, both during cross-country skiing and also during normal walking, becomes tired much sooner.

The purpose of the invention is to avoid these disadvantages and to produce a device, which is simple in structure and does not effect the dimensions and the weight of the ski boot. This purpose is attained by a heel holding assembly which in the position of use is supported on the lower boot part, having a stop, which is engaged by the rear part of the leg portion in the blocking position of the stop.

The limitation of the backward swing of the leg portion is thus provided on the heel holder independent of the ski boot. A simple structure is thereby also obtained, because only as an addition a simple stop in the form of a dog or the like is constructed on the heel holding assembly.

In special cases it may be desirous for the ski boot to be held on the sole plate between the front support and the heel part, however, also having the capability to swing rearwardly. For example, during standing or travel with the lift, a certain freedom of movement in this sense will be necessary. For this purpose, the stop has an extension, which in condition of use, grips inside the leg portion. However, if the heel holder is designed such that the stop with its extension engages the outside of the leg portion, then the leg portion can also be swung rearwardly and still a secure hold by the heel holding assembly is assured. For downhill skiing, it is then only necessary to swing the leg portion one time strongly forwardly until the latter slides off from the extension on the stop. The heel holding assembly which is under tension will now also move slightly forwardly and, during swinging backward, the extension will now again grip inside the leg portion and the backward swing will be again limited.

This construction is, however, also advantageous for cross-country skiing. If the heel holding assembly disengages from the ski boot, the ski boot, which is practically free of all additional parts, can then be slightly lifted and lowered about the front support, which preferably forms a pivot axis.

BRIEF DESCRIPTION OF THE DRAWINGS

The subject matter of the invention is exemplarily illustrated by one embodiment in the drawings, in which.

The sole plate 6 can be released from engagement with the ski either at the front end or at the rear end, both laterally of the ski and also upwardly away from the ski. If, for example, a safety release takes place at the rear end, then the rear end of the sole plate 6 slides forwardly from the support device 7 wherein, and due to the fowardly moving sole plate 6, the pin 8 is moved forwardly against the force of the associated release spring.

Figure 1:
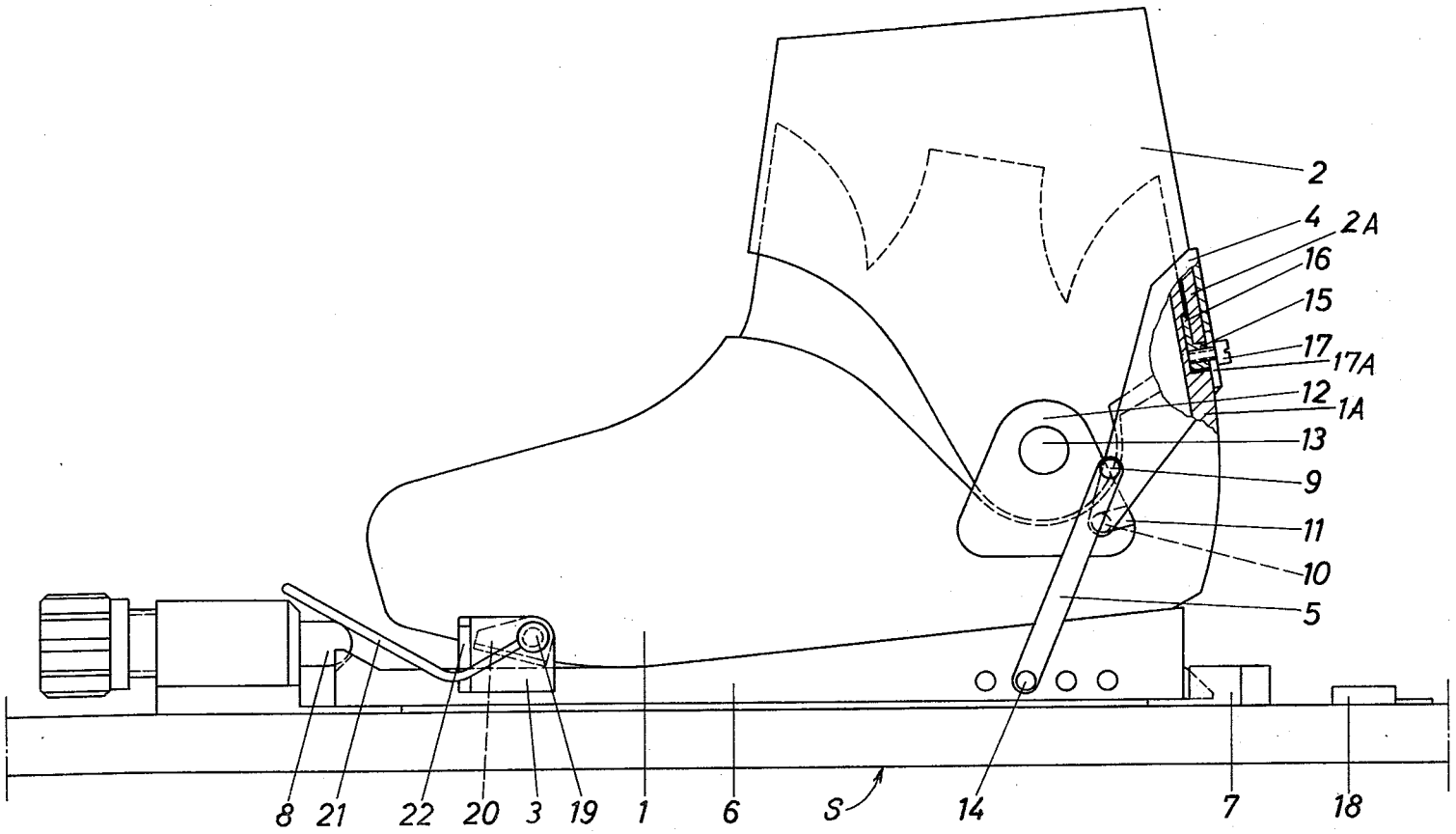
FIG. 1 is a side elevational view of a ski boot mounted on a ski and in a downhill position.

The ski boot assembly 1,2 includes a lower base part or lower shell 1 which rests on the upper surface of the sole plate 6 and an upper leg part or ankle cuff 2 which is pivotally connected to the base part 1 for movement about a horizontal pivot axle 13. The upper part 2 of the ski boot has tabs downwardly extending thereon pivotally secured to the pivot axle 13. The ski boot has a raised rear wall 1A. The relative pivoting movement between the ankle cuff or upper leg part 2 and the lower shell 1 will be in response to shifts in the weight of an individual using the boot. Part of the cuff 2 overlays at 2A the rear wall 1A with the upper edge of the rear wall being in the path of travel of the lower edge of the cuff so as to define a rearmost pivoted position of the cuff as shown in FIG. 1. A generally triangularly shaped metal fitting 12 is secured to the base part 1 on each side of the ski boot and supports the pivotal connection 13 adjacent the apex thereof. The base of the triangle is generally horizontal aligned and each of the fittings 12 has a groove or slot 11 in the rear edge thereof.

The heel holding assembly 4,5 consists substantially of a part 4, which is constructed approximately U-shaped having a pair of generally parallel legs straddling the upper part of the ski boot 2 with its center part connecting the legs and engaging, in the downhill position of use the rear upper part 2 of the ski boot assembly 1,2. The legs of the part 4 project downwardly on the laterally opposite sides of the ski boot. A lever 5 is at one end hingedly secured on each side of the ski boot through a joint 9 to one of the legs and at the other end through joint 14 to one of the longitudinally spaced locations at the sole plate 6. Inwardly extending, lateral extensions 10 are arranged on each of the legs of the U-shaped part 4 adjacent the free ends thereof. The extensions 10 are received in the grooves 11 on the ski boot assembly. As can be clearly recognized from the drawings, the heel holding assembly 4,5 is supported in the above dead-center position with the extensions 10 received in the grooves 11.

For the downhill skiing, in particular in the now popular jet style, it is necessary, however, that the swivelling of the leg portion 2 in a backward direction be limited. For this purpose, the U-shaped constructed part 4 of the heel holder has a stop 15 thereon, which is engaged in the blocking position by the rear area part 2A of the leg portion or cuff 2 when in the downhill position. The stop 15 has an extension 16 thereon which grips behind or in front of the leg portion 2A. Furthermore, it is possible to adjust the stop 15 relative to the U-shaped constructed part 4 of the heel holder. For this purpose, a screw 17 received in an elongated slot 17A in the part 4 must be loosened and, after a movement of the stop 15 relative to the part 4, it must again be tightened. The enlarged head 17 of the screw 17 is larger than the width of the slot 17A.

Figure 2:
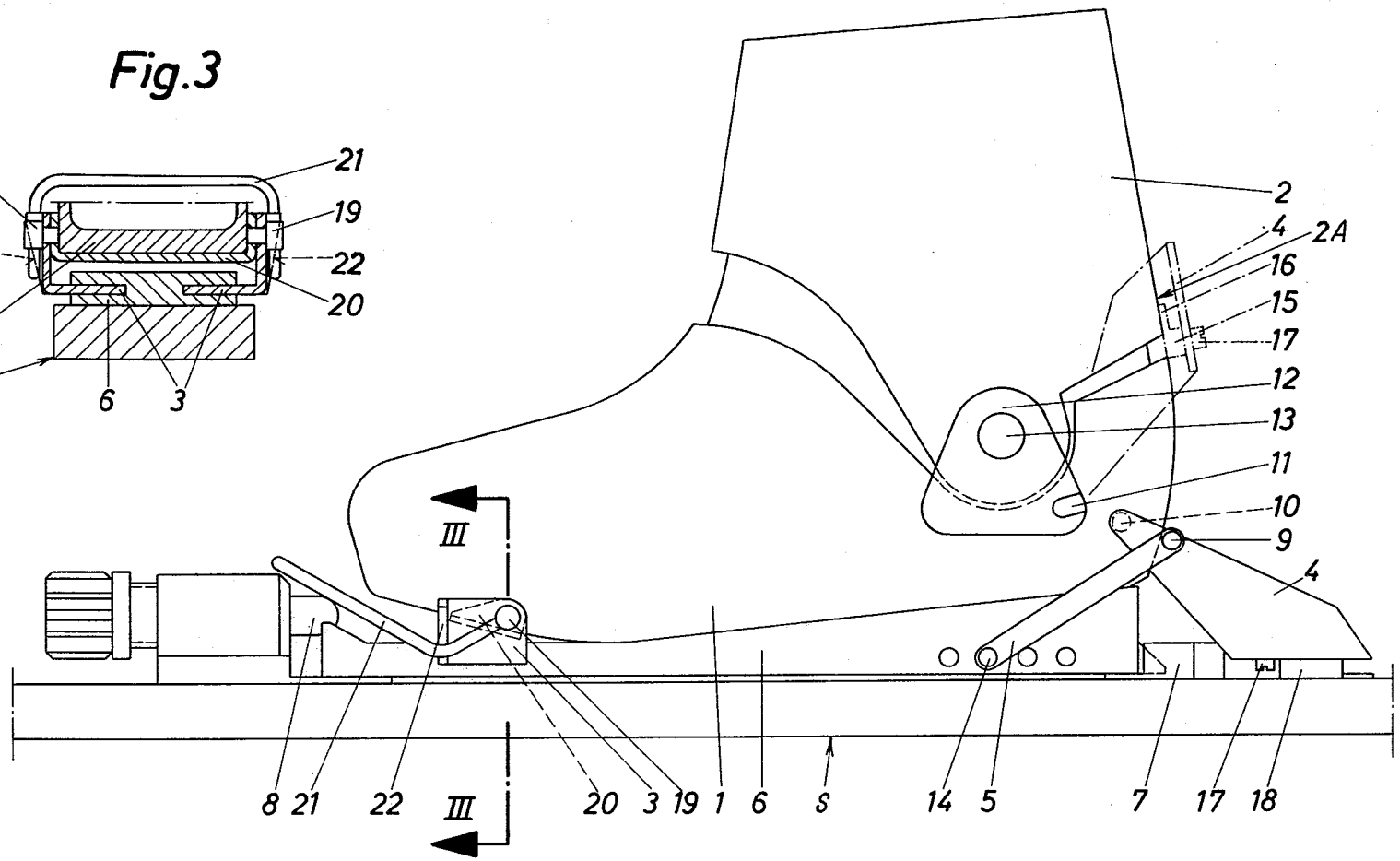
FIG. 2 is a side elevational view of the ski boot mounted on the ski and in the cross-country position.
Figure 3:
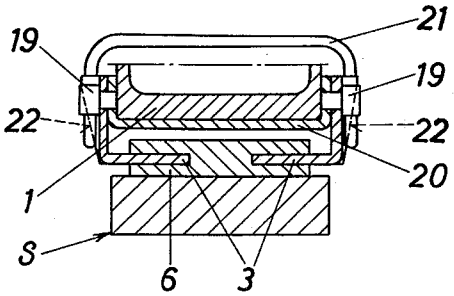
FIG. 3 is a cross-sectional view taken along the line III—III of FIG. 2. DETAILED DESCRIPTION As one can particularly recognize from FIG. 1, the ski boot assembly 1,2 is held between a front support 3 and a heel holding assembly 4,5, both being attached to a sole plate 6. The sole plate 6 is releasably secured to the ski S at the rear thereof by a support device 7 mounted on the ski S. The sole plate 6 cooperates at the front end thereof with a pin 8 mounted on the ski S and which is loaded by a release spring. The heel holding assembly 4,5 can be connected to the sole plate 6 at various longitudinally spaced locations to facilitate an adjustment to the various lengths of ski boots.

In special cases, for example during standing or during travel in the lift, it is desired that the foot with the leg portion 2 can also be moved further backwardly. This is possible if the stop 15 is swung out of the blocking position. In order to be able to assume this position, it is necessary to first swing the leg portion 2A forwardly until the stop 15 with the extension 16 can be moved rearwardly passing by below the leg portion 2A. After swinging the leg portion 2A back, the stop 15 rests then with the extension 16 on the outside of the rearward leg portion 2A, as this is shown in FIG. 2 in a dash-dotted illustration. The heel holding assembly 4,5 holds thereby still in the above dead-center position the ski boot 1,2 securely on the ski and the leg portion 2 can also be swung backwardly.

If the device is to be used for cross-country skiing, the front support 3 will advantageously form a pivot axis, about which the ski boot 1,2 can pivot upwardly. Therewith the heel holding assembly 4,5 is released from the ski boot and is held on the ski. In the present exemplary embodiment, a magnet 18, secured on the ski, is for this purpose and holds the part 4 of the heel holder. The part 4 is made of a ferromagnetic material at least in the area of the magnet. Thus, both when the skis are not used and also during cross-country skiing, a loose and freely movable heel holding assembly 4,5 is avoided.

The pivot axis at the toe of the ski boot can be formed by two bolts or pins 19 which are movably supported in a direction transversely of the ski, which bolts or pins are received in openings of a metal fitting 20 secured to the sole of the ski boot part 1. The bolts or pins 19 are secured to the ends of legs on a resilient bar 21, which legs engage sloped surfaces 22 on the front support 3. By pivoting the resilient bar 21 upwardly about the axis of the bolts or pins 19, the legs thereof slide along the sloped surfaces 22, which cause the space between them to increase, and the bolts or pins 19 are pulled laterally outwardly of the openings in the metal fitting 20 and the ski boot is then, at the end of skiing, released entirely.

The invention is not limited to the illustrated exemplary embodiment. A number of construction possibilities exist, which lie within the scope of the invention. Many different, conventional plate bindings and also fastening mechanisms on the plates can be used. It is important, however, that the heel holding assembly be equipped with a stop.

The embodiments of the invention in which an exclusive property or privilege is claimed are defined as follows:

1. In a ski binding comprising a sole plate releasably secured to a ski and having a ski boot secured to said sole plate by a front support and a heel holding assembly, the improvement comprising a ski boot having a lower shell with a raised rear wall and an ankle cuff pivotally secured to said shell to allow pivotal movement of said ankle cuff in response to shifts in the weight of an individual using the boot, said cuff in part overlying said rear wall, said rear wall having an upper edge which is in the path of travel of the lower edge of the cuff so as to define a rearmost pivoted position on the cuff, said heel holding assembly, in the position of use, having first means engaging said lower shell to hold the boot heel to said sole plate, said heel holding assembly having second means including a stop member thereon positioned in said path of travel of said cuff to limit the degree of relative pivotal movement between said cuff and said lower shell.

2. The improved ski binding according to claim 1, wherein said second means includes a part having a generally U-shape with generally parallel legs straddling the heel of said ski boot, said stop member being arranged in a center area of said part, and wherein said first means comprises the free ends of said legs supported in lateral recesses on said lower shell, and a lever providing a connection between said sole plate and said part.

3. The improved ski binding according to claim 2, wherein said lateral recesses are provided in metal fittings encircling the pivot axis between said lower shell and said cuff.

4. The improved ski binding according to claim 2, wherein said free end of said legs includes lateral extensions, said lateral extensions being received in said recesses.

5. The improved ski binding according to claim 2, wherein means are provided for connecting said stop member and said part whereby said stop member is adjustable between fixed positions on said U-shaped part of said heel holding assembly.

6. The improved ski binding according to claim 1, including holding means secured to said ski for securing said heel holding assembly when said first means is disengaged from said lower shell to free said boot heel from said sole plate in a non-use condition.

7. The improved ski binding according to claim 6, wherein said holding means comprise a magnet secured to said ski; and wherein said center area of said U-shaped part of said heel holding assembly rests in non-use condition on and is held by said magnet.

8. The improved ski binding according to claim 7, wherein, in said non-use condition of the heel holding assembly, when said U-shaped part rests on said magnet, said ski boot is held only by said front support, said front support including means defining a pivot axis for the toe of the ski boot for use in cross-country skiing.

9. The improved ski binding according to claim 8, wherein said pivot axis is defined by two bolts which are transversely movably supported transversely of the ski.

10. The improved ski binding according to claim 9, wherein said bolts are secured at the ends of a resilient bar.

11. The improved ski binding according to claim 10, wherein the ends of the resilient bar engage sloped surfaces mounted on said sole plate to effect a disengagement of said bolts from the ski boot upon relative movement of said bar and said sole plate.

12. The improved ski binding according to claim 1, wherein said stop membe has an extension thereon which, in position of use, grips inside said lower edge of said cuff.

13. The improved ski binding according to claim 1, wherein said second means is selectively positionable outside of said path of travel while said first means is engaged with said lower shell to hold the boot heel to said sole plate.

* * * * *

UNITED STATES PATENT AND TRADEMARK OFFICE

CERTIFICATE OF CORRECTION

PATENT NO. : 4 050 716

DATED : September 27, 1977

INVENTOR(S) : Axel R. Kubelka and Gottfried Schweizer

It is certified that error appears in the above-identified patent and that said Letters Patent are hereby corrected as shown below:

Please change Assignee's Address to read "Baar/Zug, Switzerland".

Column 4, line 14; change "on" to ---of---.

Column 5, line 8; change "membe" to ---member---.

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*